United States Patent [19]

Ishihara

[11] 4,289,456

[45] Sep. 15, 1981

[54] UNDERWATER PUMP

[76] Inventor: Masamitsu Ishihara, 628 Hirai, Kannami-cho,, Tagata-gun, Shizuoka-ken,, Japan

[21] Appl. No.: 954,770

[22] Filed: Oct. 26, 1978

[30] Foreign Application Priority Data

May 24, 1978 [JP] Japan ..... 53/62098
May 24, 1978 [JP] Japan ..... 53/62099
May 24, 1978 [JP] Japan ..... 53/62100

[51] Int. Cl.[3] ..... F04B 17/00
[52] U.S. Cl. ..... 417/364; 123/198 P
[58] Field of Search ..... 417/364; 123/1 R, 195 C, 123/198 P; 114/337, 315

[56] References Cited

U.S. PATENT DOCUMENTS 2,191,879 2/1940 Dunajeff ..... 114/337 X
2,429,732 10/1947 Roos ..... 123/1 R
3,892,079 7/1975 Hirano et al. ..... 91/527
4,201,524 5/1980 Wilkins ..... 417/364

FOREIGN PATENT DOCUMENTS 105495 4/1917 United Kingdom ..... 114/337

*Primary Examiner*—Richard E. Gluck

[57] ABSTRACT

An underwater pump which comprises an engine received in liquidtightness in a capsule, and wherein the suction pipe and exhaust pipe of the engine are each open at one end on the surface of the wafer. The exhaust pipe is cooled by the surrounding water. A water-collecting chamber is formed at the lower end of the exhaust pipe to collect water drops deposited on the inner wall surface of the exhaust pipe, the collected water being drawn off to the outside. A connection pipe provided with a flow control valve communicates with a discharge water hose. Air remaining in an impeller casing or part of the discharge water pressurized by the impellers is carried into the discharge water hose through the connection pipe. Engine-cooling water is held in a water tank shut off from the surrounding discharge water. The engine-cooling water brought pack through a return path from the engine capsule is cooled by discharge water drawn into the underwater pump.

6 Claims, 11 Drawing Figures

UNDERWATER PUMP

BACKGROUND OF THE INVENTION

This invention relates to an underwater pump and more particularly to a pump adopted to be immersed in the water which is to be discharged thereby.

Based on the installed position, pumps are classified into the customary type set on the ground and the underwater type immersed in the water which is to be discharged thereby. Hitherto, most of the known underwater pumps have been driven by an electric motor and consequently failed to be used in a locality where no electric power source is available for use. Further, operation of the underwater pump requires a driving source (power source) such as a dynamo. Therefore, the underwater pump has been subject to certain limitations in application.

SUMMARY OF THE INVENTION

It is accordingly an object of this invention to provide an underwater pump which is driven by an engine and in consequence can be readily applied in a locality where no electric power source is available for use.

According to this invention, therefore, an engine is sealed in a capsule. The capsule, together with the pump, is immersed in the water which is to be discharged by the pump. The suction pipe and exhaust pipe of the engine are each open at one end above the water surface. The exhaust pipe is cooled by the surrounding water. The present underwater pump can be continuously operated by an engine with the engine capsule cooled by the surrounding water. The exhaust gas which passes through the exhaust pipe is cooled by the surrounding water and further is directly cooled by water particles or drops deposited by condensation on the inner wall surface of the exhaust pipe which effectively decreases the temperature of the exhaust gas. Therefore, the upper end portion of the exhaust pipe can be formed of a flexible hose prepared from, for example, polyvinylchloride or rubber, thereby facilitating the transport and handling of the underwater pump.

Since the engine capsule is cooled by the surrounding water, the engine of the underwater pump is indirectly cooled. It is also possible directly to cool the engine by the surrounding water. For most effective cooling of the engine, the underwater pump should preferably be provided with a direct cooling system.

Exhaust gas is drawn off at a low temperature through the exhaust pipe of the underwater pump which is cooled by the surrounding water. Therefore, the underwater pump should preferably be so constructed as to enable the temperature of the exhaust gas to be reduced as much as possible.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1:
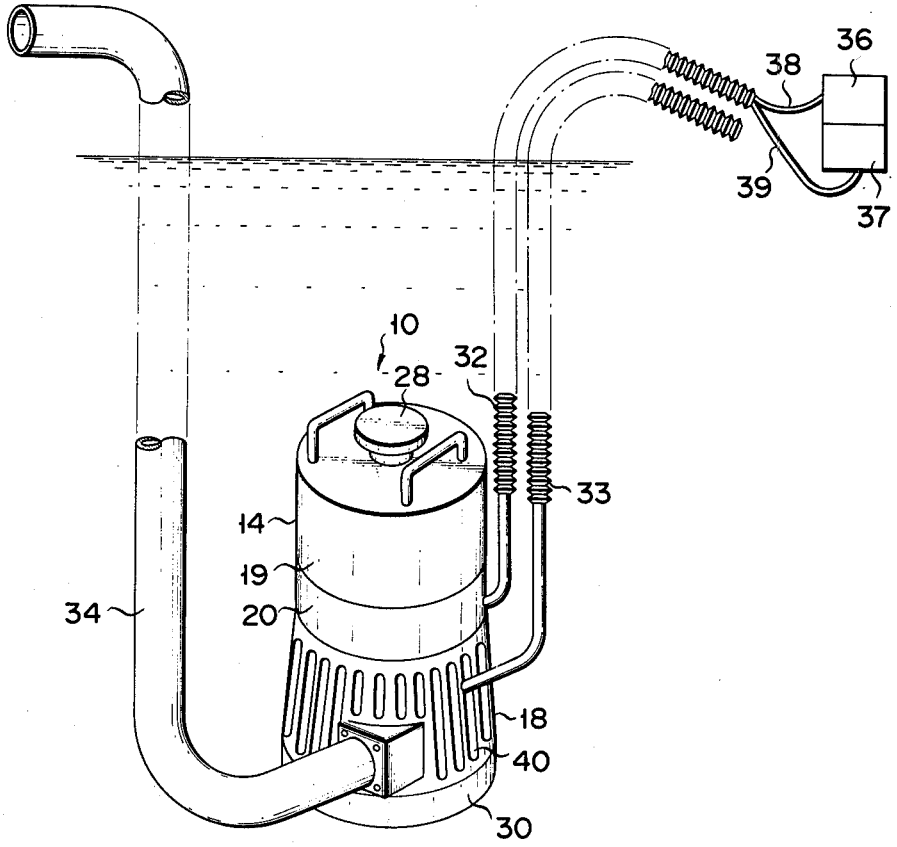
FIG. 1 is a schematic perspective view of a vertical type underwater pump according to one embodiment of this invention.

The underwater pump of FIGS. 1 and 2 according to one embodiment of this invention comprises an engine capsule 14 for holding an engine 12 in liquidtightness and a strainer 18 which contains a large number of impellers 16 and is positioned below the engine capsule 14. The engine capsule 14 is formed of two separable half capsules 19, 20. The lower half capsule 20 is provided with a support member 22. An arcuate support arm 24 extends upward from the support member 22 along the inner wall of the upper half capsule 19. A cover provided with a bolt 28 is threadedly fitted into a screw hole 25 of the support arm 24 through a hole 26 penetrating the upper half capsule 19. When released from threaded engagement with the cover nut 28, the upper half capsule 19 is separated from the lower half capsule 20. Since, at this time, the upper portion of the engine 12 is exposed to the outside, it is possible to start the engine 12 or carry out its maintenance. An engine-cooling water tank 30 is set below the strainer 18. A suction pipe 32 extends outward from the capsule 14. An exhaust pipe 33 and discharge water hose 34 extend outward from the strainer 18. The openings of these tubular members 32, 33, 34 are obviously positioned above the water surface when the underwater pump 10 is set in place. The lower portions of the suction pipe 32 and exhaust pipe 33 are made of iron, and the engageable upper portions thereof are formed of a flexible hose prepared from, for example, polyvinylchloride or rubber. The discharge water hose 34 wholly consists of a flexible hose prepared from, for example, polyvinylchloride or rubber.

A control panel 36 for controlling the operation of an engine and a fuel tank 37 are integrally constructed in compact form and set on the ground. For easy transport, these units should preferably be built integrally on a wagon. A cable 38 and fuel hose 39 are inserted into the engine 12 through the suction pipe 32. The peripheral wall of the strainer 18 are bored with a large number of slits 40 for sucking water being discharged by the underwater pump (hereinafter referred to as discharge water). The slits 40 are so constructed as to be prevented from sucking in, for example, rubbish.

Figure 2:
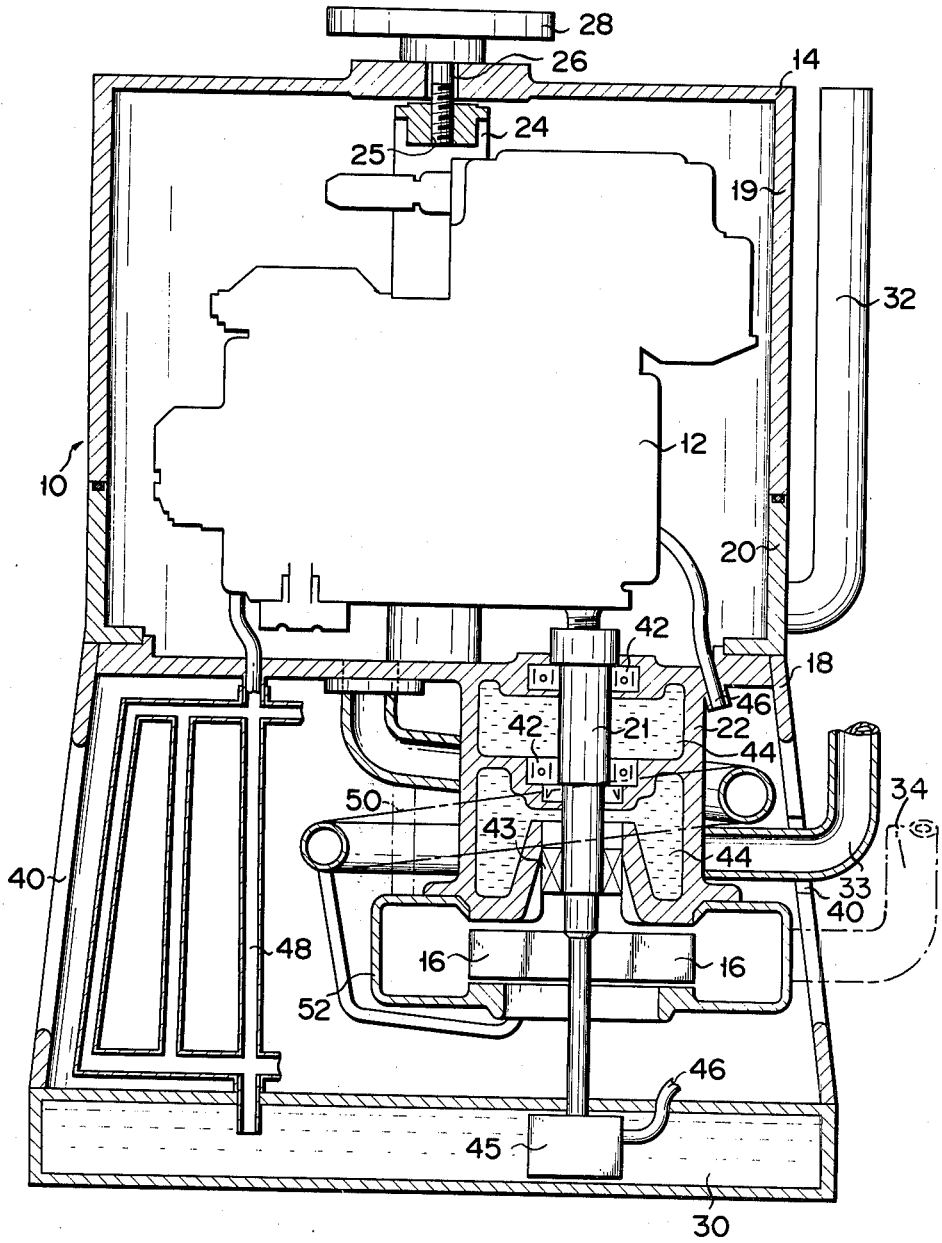
FIG. 2 is a longitudinal sectional view of the vertical type underwater pump of FIG. 1.

As seen from FIG. 2, an output shaft 21 of the engine 12 is securely held on the support member 22 by means of a plurality of bearings 42. A mechanical seal 43 is provided at the lower end of the support member 22. Two oil chambers 44 are defined by the bearings 42 and mechanical seal 43 around the output shaft 21, respectively. A pump 45 is received in the engine-cooling tank 30 in a form fitted to the lower end of the output shaft 21. The engine-cooling tank 30 holds cooling water shut off from the surrounding water. The cooling water is conducted by the pump 45 through a cooling water pipe 46 to the cooling water passage of the engine. After absorbing heat from the engine 12, the cooling water is returned to the engine-cooling tank 30 through a separate return pipe 48. This return pipe 48 is constructed in the form of a manifold to be effectively cooled by discharge water when it is sucked into the housing 14 through the slits 40 of the strainer 18 to increase the running speed. Accordingly, the cooling water circulating through the engine-cooling tank 30 is cooled not only by the surrounding still water, but also by running water sucked in through the slits 40, thereby effectively cooling the engine 12 all the time.

The pump 45 connected to the lower end of the output shaft 21 of the engine 12 is simplified in construction and jointly works with the engine 12, thereby always ensuring a reliable effective operation. However, the pump 45 need not be restrictively fitted to the lower end of the output shaft 21. It is possible to fit a separate shaft to the pump 45 and cause the shaft to be operated jointly with the output shaft 21 of the engine 12 by means of a pulley and V-belt.

The engine is cooled by sealed pressurized circulating water, making it necessary always to hold cooling water in the engine-cooling tank 30. To this end, therefore, the cooling water held in the cooling tank 30 should be set at a level the same as or lower than the impellers 16 and at least lower than the slits 40 of the strainer 18. This arrangement enables the engine-cooling water to be cooled by streams of water sucked into the cooling tank 30 when water is discharged by the underwater pump 10 and the still water surrounding the sealed cooling water and, even when the above-mentioned streams of water are not sucked in, by the surrounding still water.

The greater part of the exhaust pipe 33 is immerged in the water, through the open end thereof lies above the water surface. Therefore, the exhaust pipe 33 is cooled not only by the surrounding water but also by water particles deposited on the inner wall surface thereof. The exhaust just released generally stands at a temperature of 200° to 250° C. However, this exhaust pipe-cooling system prominently decreases the temperature of the exhaust to a low level of 50° to 60° C. as experimentally determined. Since the exhaust pipe 33 has its temperature noticeably reduced as described above, the exhaust pipe 33 need not be formed of an iron pipe throughout. But the upper portion thereof may consist of an inexpensive hose made of, for example, polyvinylchloride or rubber. Where the exhaust pipe 33 is built of a combination of a flexible hose of polyvinylchloride or rubber and an iron pipe , it is possible to broaden uses of the installation of an underwater pump 10 to a greater extent than if the exhaust pipe 33 were completely formed from a rigid material such as iron. The above-mentioned composite structure, renders the exhaust pipe 33 more readily portable. The suction pipe 32 of the engine 12 is also advantageously made of the above-mentioned flexible polyvinylchloride or rubber hose for similar reasons.

Figure 3:
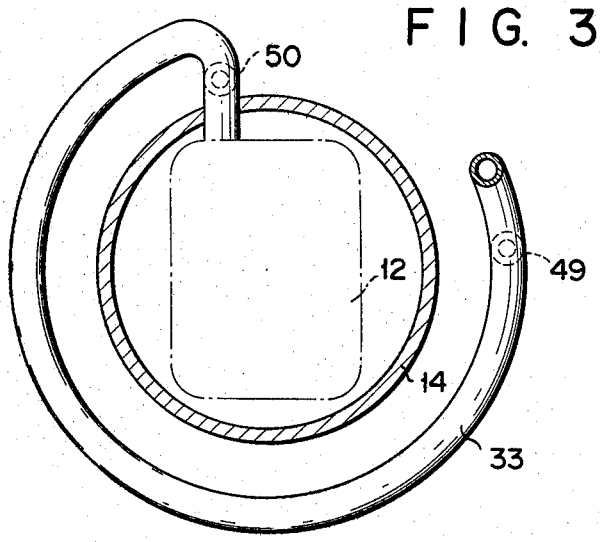
FIG. 3 is a cross sectional view of the lower end portion of the exhaust pipe of the vertical type underwater pump of FIG. 1.

The exhaust pipe 33 connected to the strainer 18 should preferably be so constructed as to be more effectively cooled by collecting water drops deposited by condensation on the inner wall surface of the exhaust pipe 33. To this end, it is advised, as seen from FIG. 3, to let the lower end portion of the exhaust pipe 33 take a form wound about the engine capsule 14 or provide a cooling chamber. The partly circular wound portion may be horizontally positioned. However, to accelerate the flow of water streams to the later described water-collecting means 49, it is possible to incline the wound portion slightly downward toward a water-collecting chamber. Obviously, the wound portion need not be formed of a single wall, but may take a multiwalled coiled form.

The downwardly inclined wound portion thus directs water droplets resulting from condensation of the exhaust gases away from the engine.

Figure 4A:
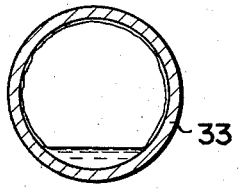
FIGS. 4A, 4B are cross sectional views of the exhaust pipe.
Figure 4B:
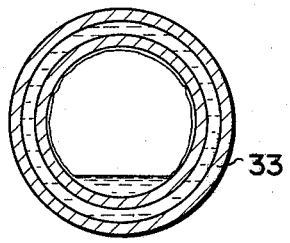

The underwater pump 10 is generally immersed in the water with the engine-cooling tank 30 set at the bottom. Where, therefore, the underwater pump 10 fully sinks into the water, the exhaust pipe 33 is also completely immersed in the water, thereby effectively cooling the exhaust. To this end, therefore, the exhaust pipe 33 is generally formed of a single wall as illustrated in FIG. 4A. To elevate the cooling effect, however, the exhaust pipe 33 may be of a multiwalled type, for example, it may be formed of two walls to introduce part of discharge water into a space defined between both walls as shown in FIG. 4B. The above-mentioned process of conducting part of discharge water into a space defined between the respective adjacent walls of a multiwalled exhaust pipe 33 positively cools the exhaust passing through the innermost wall thereof. This process proves particularly effective, where the water is so shallow that the underwater pump 10 is immersed therein only partly, and the exhaust pipe 33 is exposed to the atmosphere.

Figure 5A:
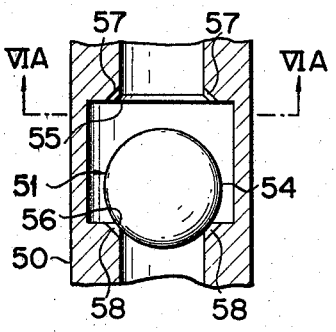
FIGS. 5A, 5B are longitudinal sectional views of a connection pipe.

Referring to FIG. 2, the strainer 18 contains a casing 52 in which a large number of impellers 16 are received. Air held in the casing 52 still remains therein even after the underwater pump 10 sinks into the water. The residual air is progressively drawn off through the discharge water hose 34, together with pressurized water produced by the rotation of the impellers 16. During the initial operating state of the underwater pump 10, however, water is discharged at a low rate due to the presence of the residual air. The residual air can be forcefully taken out not only through a drawn port (not shown) provided with a valve, but also by any other means.

Where the exhaust pipe 33 is of the multiwalled type as in FIG. 4B, and discharge water is partly drawn into spaces defined between the respective adjacent walls, it is possible to bore holes in the adjacent walls except for the innermost wall, thereby allowing the free flow of discharge into and out of the interwall spaces. In this case, the discharge water used to cool the exhaust should preferably run through the innerwall spaces under pressure. The optimum process is to introduce cooling water directly into the exhaust pipe 33 and forcefully expel air remaining in the casing 52. In this case, it is necessary quickly to remove air left in the casing 52 as much as possible. In contrast, cooling water should be continuously supplied to the exhaust pipe 33, even if the water runs in a small quantity. This technical requirement is met by a connection pipe 50 of FIG. 5A provided with a flow control valve.

Figure 5B:
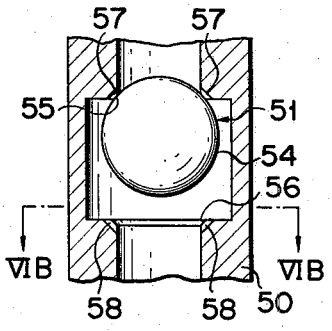
Figure 6A:
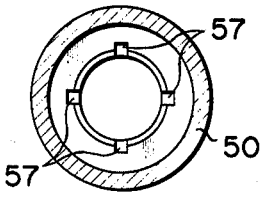
FIGS. 6A, 6B are respectively the cross sectional views taken along lines VIA—VIA and VIB—VIB of FIGS. 5A, 5B.
Figure 6B:
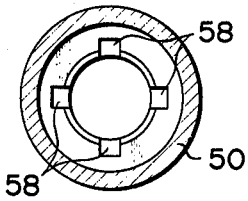

The connection pipe 50 provided with a flow control valve is set between the exhaust pipe 33 and casing 52 (FIG. 2). The connection pipe 50 has a flow control valve 51 disposed in the intermediate part. This flow control valve 51 is provided with a valve ball 54. The flow control valve 51 is further fitted with a pair of chamfered valve seats 55, 56, which are respectively provided with four inward inclined by-passes 57, 58 (FIGS. 5A, 5B, 6A, 6B). The four by-passes 57 formed in the upper valve seat 55 have a smaller cross sectional area than the four by-passes 58 formed in the lower valve seat 56. When the impellers 16 are rotated jointly with the engine 12, air remaining in the impeller casing 52 flows into the exhaust pipe 33 through the larger by-passes 58, because the valve ball 54 is pressed by its oun weight against the surface of the lower valve seat 56. When all the residual air is drawn off, the underwater pump 10 effectively carries out its original function. Discharge water fully drawn into the casing 52 by the rotation of the impellers 16 is forcefully centrifuged by the impellers 16 and thrown out through the discharge water hose 34. At this time, the valve ball 54 of the flow control valve 51 is shifted upward by water pressure (FIG. 5B). Part of the discharge water runs into the exhaust pipe 33 through the smaller by-passes 57.

The lower valve seat 56 of the flow control valve 51 mounted on the connection pipe 50 is provided, as previously described, with by-passes 58 having a larger cross sectional area. Air left in the impeller casing 52 runs out in large quantities through the larger by-passes 58 to be quickly eliminated. The valve ball 54 is pressed against the upper valve seat 55 by the pressure of the discharge water running through the flow control valve 51 when the residual air is drawn off. Therefore, the discharge water is conducted through the by-passes 57 having a smaller cross sectional area to be prevented from flowing in large quantities. As the result, limited amounts of discharge water continuously pass through the exhaust pipe 33. As described above, part of the discharge water is conducted as a coolant through the connection pipe 50 provided with a flow control valve to a space defined between the two walls of the exhaust pipe 33.

Figure 7:
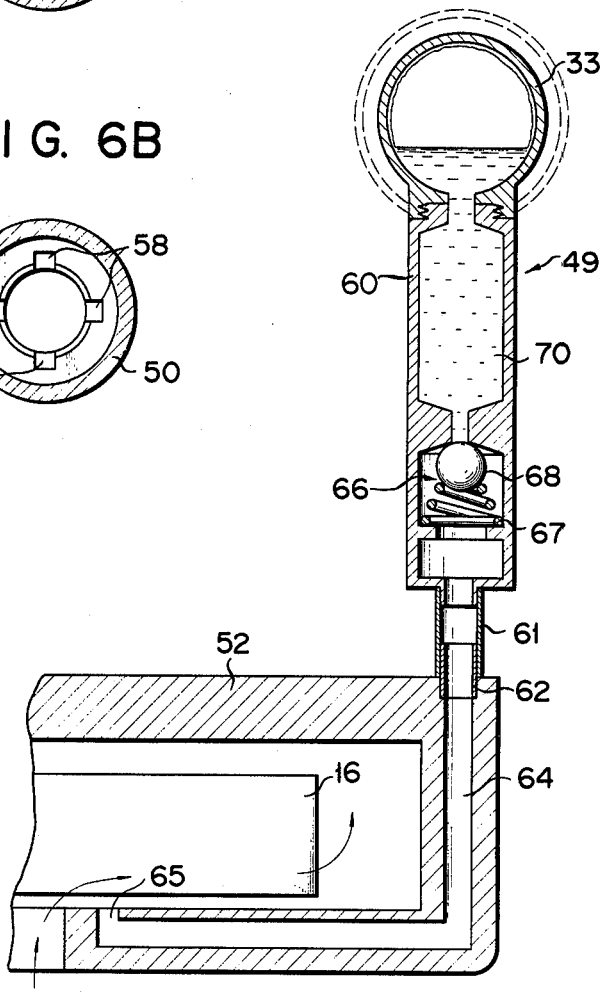
FIG. 7 is a longitudinal sectional view of water-collecting means.

When the exhaust pipe 33 is cooled, water particles settled on the inner wall surface thereof grow into water dropes and run down the exhaust pipe 33 in the form of water streams. Exhaust passing through the exhaust pipe 33 has its temperature rapidly decreased from the original level of 200° to 250° C. down to a much lower level of 50° to 60° C., giving rise to the generation of considerable amounts of water drops. Though having a cooling effect, these water drops tend to obstruct the free flow of exhaust, if accumulated in large quantities. Water drops deposited in the inner wall surface of the exhaust pipe 33 progressively increase in amount, as the engine operation is continued, and consequently have to be removed at a proper time interval. From the standpoint of elevating the exhaust-cooling efficiency, it is preferred to remove water drops already used to cool exhaust and accelerate the growth of fresh water drops. To this end, the lower end portion of the exhaust pipe 33 of an underwater pump 10 embodying this invention is slightly bent downward. The lowermost portion of the exhaust pipe 33 is fitted with water-collecting means 49 (FIG. 7).

The water-collecting means 49 comprises a water-collecting pipe 60 provided with a check valve. The water-collecting pipe 60 is threadedly engaged at one end with the exhaust pipe 33 and is connected at the other end to the impeller casing 52 by means of fitting implements 61, 62. The water-collecting pipe 60 communicates with a water pipe 64. The open end 65 of the water pipe 64 faces the region where a negative pressure is generated by the rotation of the impellers 16. The open end of the water-collecting pipe 60 may be made directly to face the region where a negative pressure is generated by the impellers.

The intermediate part of the water collecting pipe 60 is fitted with a check valve 66, which presses a valve ball 68 pressed against a valve seat by an urging member, for example, a conical coil spring 67. The water-collecting pipe 60 comprises a water-collecting chamber 70 for temporarily holding water drops produced on the inner wall surface of the exhaust pipe 33. The chamber 70 is positioned between the check valve 66 and the exhaust pipe 33. When the impellers 16 are rotated, water drops attached to the proximity of the ends of the impellers 16 are centrifugally thrown off. On the other hand, a negative pressure is generated by water brought into the impeller casing 52 near the base portions of the impellers 16, where a negative pressure is produced by the impellers 16 themselves. The opening 65 of the water pipe 64 communicating with the water-collecting pipe 60 faces the region where a negative pressure is applied by the impellers 16. Therefore, a sucking force is created in the water pipe 64 extending from the opening 65 to the check valve 66. As the result, the valve ball 68 of the check valve 66 is removed from the valve seat against the urging force of the spring 67, causing the water held in the water-collecting chamber 70 to flow into the impeller casing 52 through the check valve and water pipe 64. During the operation of the impellers 16, water continues to run from the water-collecting chamber 70 to the impeller casing 52, thereby ensuring the free flow of exhaust.

Figure 8:
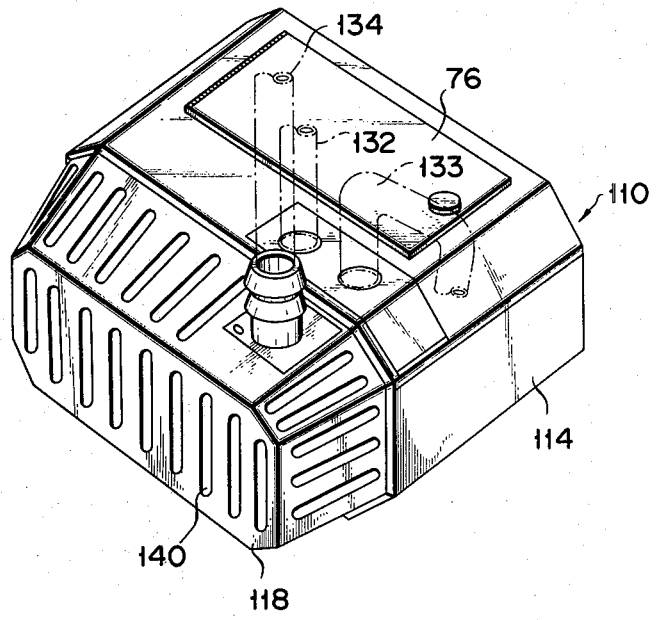
FIG. 8 is a schematic perspective view of a horizontal type underwater pump according to another embodiment of the invention.

There will now be described by reference to FIG. 8 an underwater pump according to another embodiment of the invention. This embodiment is a horizontal type in which the engine and impellers are spatially set in a horizontal direction. The parts of this second embodiment are denoted by the numerals of the corresponding parts of the first embodiment to which a number of "100" is prefixed. The capsule 114 of this horizontal underwater pump 110 is not formed of a pair of separable half capsules. The maintenance of the engine and other parts thereof are effected by opening a capsule cover 76. The underwater pump 110 of the second embodiment which has a broad bottom plane is easily installed in a proper position under water. This underwater pump 110 which has a smaller height than the vertical type 10 and whose suction slits 140 are formed in the lower section can effectively function even in shallow water.

With an underwater pump embodying this invention, the impellers are driven by an engine. A capsule sealing the engine is easily cooled by the surrounding water. Therefore, the invention provides a continuously operable compact high output underwater pump which is readily applicable in a locality where no electric power source is available for use. The exhaust pipe opens at one end on the surface of the discharge water. The greater part of the exhaust pipe is cooled by the surrounding water. Exhaust in the exhaust pipe is cooled not only by water surrounding the exhaust pipe, but also directly by water particles or drops deposited on the inner wall surface of the exhaust pipe, leading to a prominent decline in the temperature of the exhaust. Accordingly, part of the exhaust pipe can be formed of a flexible hose prepaired from, for example, polyvinylchloride or rubber, offering great advantage in the transport and handling of an underwater pump.

A connection pipe provided with a flow control valve communicates at one end with a discharge water pipe, and at the other end with the impeller casing or discharge water pipe. Whereby, when the impellers are rotated, air remaining in the impeller casing is first drawn off into the discharge water pipe through the flow control valve of the connection pipe. Later, part of the pressurized water is also carried into the discharge water pipe, thereby effectively cooling exhaust gases passing through the exhaust pipe. Since air remaining in the impeller casing is removed, water is fully discharged even at the very beginning of the rotation of the impellers. The flow control valve mounted on the connection pipe provides a broader passage when the residual air flows through the valve than when part of the discharge water runs therethrough, leading to the rapid removal of residual air from the impeller casing.

Cooling water shut off from the surrounding water circulates between a water tank and engine capsule. Cooling water passing through a return path provided between the engine capsule and water tank is cooled by discharge water drawn into the underwater pump through the suction slits. The cooling water conducted through the return path should preferably be brought back to the water tank through a manifold set behind the suction slits. Discharge water entering the suction slits has a sufficiently high flow rate to absorb the heat of the cooling water conducted through the manifold. Accordingly, the exhaust-cooling water is always kept at a low temperature, ensuring the effective cooling of the engine.

What is claimed is:

1. An underwater pump which comprises an engine received in a capsule in liquidtightness to drive impellers within an impeller casing when the pump body and engine capsule are immersed in water, said engine being connected to a suction pipe and exhaust pipe, each open at one end above the surface of the water, the exhaust pipe being cooled by the water and the lower end thereof being provided with a water-collecting section downwardly inclined from the horizontal direction to collect water deposited on the inner wall surface of the exhaust pipe and discharge same, water-collecting means disposed disposed between the lower end portion of the inclined water-collecting section and the impeller casing and designed forcefully to discharge water accumulated in the exhaust pipe by means of a negative pressure generated by water flowing into the impeller casing by the rotation of the impellers.

2. The underwater pump according to claim 1, wherein the water-collecting means comprises a check valve for admitting the flow of water from the exhaust pipe to the impeller casing and obstructing the run of water in the opposite direction; and a water-collecting chamber set between the check valve and exhaust pipe temporarily to hold water drops deposited on the inner wall surface of the exhaust pipe.

3. The underwater pump according to claim 1, or 2, wherein a connection pipe provided with a flow control valve communicates with the exhaust pipe; and air remaining in the impeller casing or part of discharge water pressurized by the impellers is drawn off into the discharge pipe through the connection pipe.

4. The underwater pump according to claim 3, wherein the flow control valve in the connection pipe comprises a valve member and a pair of vertically spaced valve seats; and the paired valve seats are respectively provided with at least one by-pass for admitting the partial flow of a fluid even when the valve member is pressed against one of the paired valve seats.

5. The underwater pump according to claim 4, wherein the valve member of the flow control valve is normally pressed against the lower valve seat; and the by-pass formed in the lower valve seat has a larger cross sectional area than that formed in the upper valve seat.

6. The underwater pipe according to claim 5, wherein the exhaust pipe comprises two concentric pipes forming a central conduit for exhaust gas and an annular space for cooling water, and the connection pipe communicates with said annular space thereby conducting air remaining in the impeller casing or part of the discharge water to said annular space.

* * * * *